US005314369A

United States Patent [19]

Gamble

[11] Patent Number: 5,314,369

[45] Date of Patent: May 24, 1994

[54] TWIRLING TOY

[76] Inventor: Paul H. Gamble, 8330 SW. Pine St., Portland, Oreg. 97223-8779

[21] Appl. No.: 933,769

[22] Filed: Aug. 24, 1992

[51] Int. Cl.[5] ..... A63H 1/06; A63H 3/52; A63B 67/10

[52] U.S. Cl. ..... 446/247; 446/267; 273/414

[58] Field of Search ..... 446/240, 247, 250, 253, 446/267; 273/414, 449; 40/409, 410; D21/98, 99, 102

[56] References Cited

U.S. PATENT DOCUMENTS 1,374,002 4/1921 Edson ..... 446/247
1,915,868 6/1933 Rogers ..... 446/247
3,608,235 9/1971 Harton ..... 446/247
4,817,311 4/1989 Ong ..... 40/410
4,961,276 10/1990 Lin ..... 40/410

*Primary Examiner*—Robert A. Hafer
*Assistant Examiner*—Gregory Stone
*Attorney, Agent, or Firm*—Leon Gilden

[57] ABSTRACT

A twirling toy includes an elongate shaft having a first end spaced from a second end in a longitudinally aligned relationship. The second end includes a bifurcated leg structure having a flexible cord directed through the leg structure and extending through a handle shaft bore orthogonally oriented relative to leg bores of each of the legs. Spheres are mounted at free ends of the cord, with the spheres arranged for rotation upon manipulation of the handle shaft.

3 Claims, 4 Drawing Sheets

TWIRLING TOY

BACKGROUND OF THE INVENTION

1. Field of the Invention

The field of invention relates to twirling toy apparatus, and more particularly pertains to a new and improved twirling toy wherein the same is arranged to permit the contrarotation of respective spheres mounted to the toy structure.

2. Description of the Prior Art

Twirling toys of various types are utilized in the prior art for the entertainment and amusement of children and the like. Further, manual dexterity is further enhanced by manipulation of the toy structure. While prior art twirling toy structures addressed in the prior art and exemplified by the U.S. Pat. Nos. 4,112,611; 4,437,261; 4,291,874; and 3,895,457, the prior art has heretofore not presented the unique inter-relationship of spheres mounted to a flexible cord to permit their contrarotation relative to a central shaft and in this respect, the present invention substantially fulfills this need in the entertainment and amusement of individuals.

SUMMARY OF THE INVENTION

In view of the foregoing disadvantages inherent in the known types of twirling toy apparatus now present in the prior art, the present invention provides a twirling toy wherein the same mounts a plurality of spheres relative to individual legs of a shaft structure to permit manual rotation and manipulation of the spheres during use of the toy. As such, the general purpose of the present invention, which will be described subsequently in greater detail, is to provide a new and improved twirling toy which has all the advantages of the prior art twirling toy apparatus and none of the disadvantages.

To attain this, the present invention provides a twirling toy including an elongate shaft having a first end spaced from a second end in a longitudinally aligned relationship. The second end includes a bifurcated leg structure having a flexible cord directed through the leg structure and extending through a handle shaft bore orthogonally oriented relative to leg bores of each of the legs. Spheres are mounted at free ends of the cord, with the spheres arranged for rotation upon manipulation of the handle shaft.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved twirling toy which has all the advantages of the prior art twirling toy apparatus and none of the disadvantages.

It is another object of the present invention to provide a new and improved twirling toy which may be easily and efficiently manufactured and marketed.

It is a further object of the present invention to provide a new and improved twirling toy which is of a durable and reliable construction.

An even further object of the present invention is to provide a new and improved twirling toy which is susceptible of a low cost of manufacture with regard to both materials and labor, and which accordingly is then susceptible of low prices of sale to the consuming public, thereby making such twirling toys economically available to the buying public.

Still yet another object of the present invention is to provide a new and improved twirling toy which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
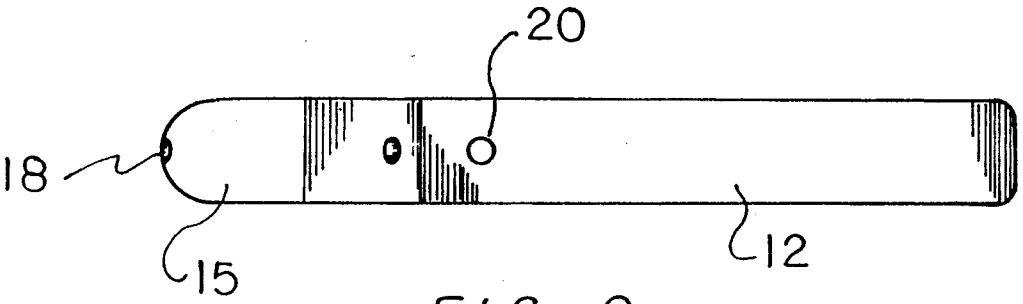
FIG. 2 is an orthographic top view of the handle shaft structure.
Figure 3:
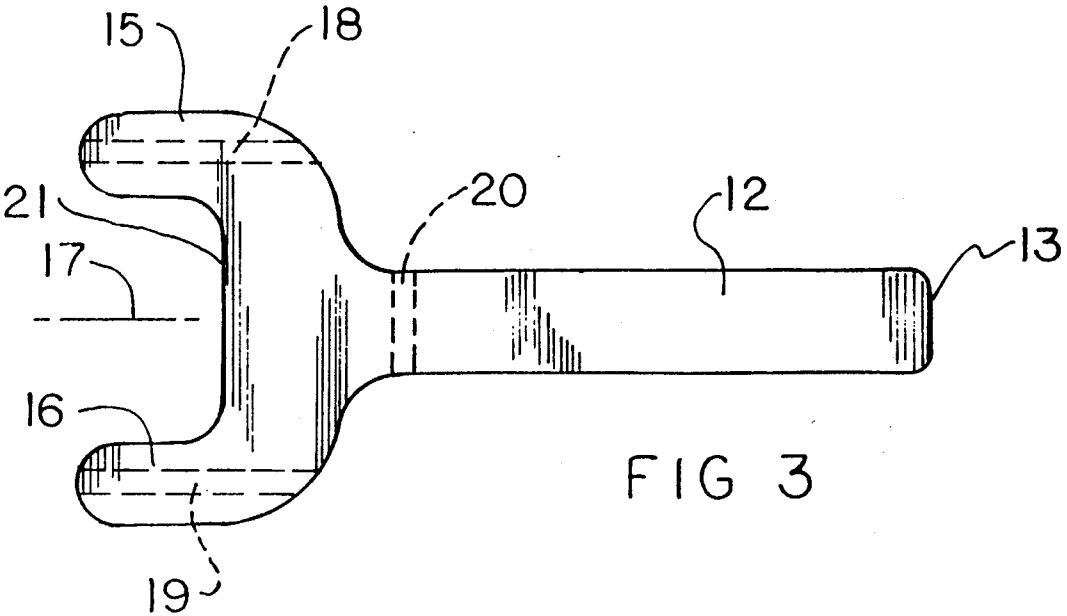
FIG. 3 is an orthographic side view of the handle shaft structure.
Figure 1:
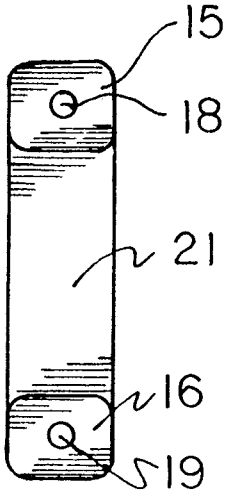
FIG. 1 is an orthographic end view of the handle shaft of the invention.

With reference now to the drawings, and in particular to FIGS. 1 to 11 thereof, a new and improved twirling toy embodying the principles and concepts of the present invention and generally designated by the reference numeral 10 will be described.

More specifically, the twirling toy 10 of the instant invention essentially comprises a handle member 11 having an elongate, rigid shaft 12 longitudinally aligned about a handle shaft axis 17. The shaft includes a first free end 13 spaced from a bifurcated second end 14. The bifurcated second end 14 includes a first leg 15 arranged parallel to the second leg 16, with the leg spaced an equal distance relative to the axis 17. A first leg bore 18 is directed through the first leg 15, with a second leg bore 19 directed through the second leg 16, with the first and second leg bores 18 and 19 arranged parallel to and relative one another, the axis 17 an equal distance relative to the axis 17 in construction. A handle shaft bore 20 is directed orthogonally through the handle shaft 12 oriented orthogonally relative to the handle axis and positioned in adjacency relative to the bifurcated second end 14. A connecting web 21 is indicated to interconnect the first and second legs 15 and 16 to provide for a unitary and integral handle member 11 construction.

Figures 4, 5, 6, 7:
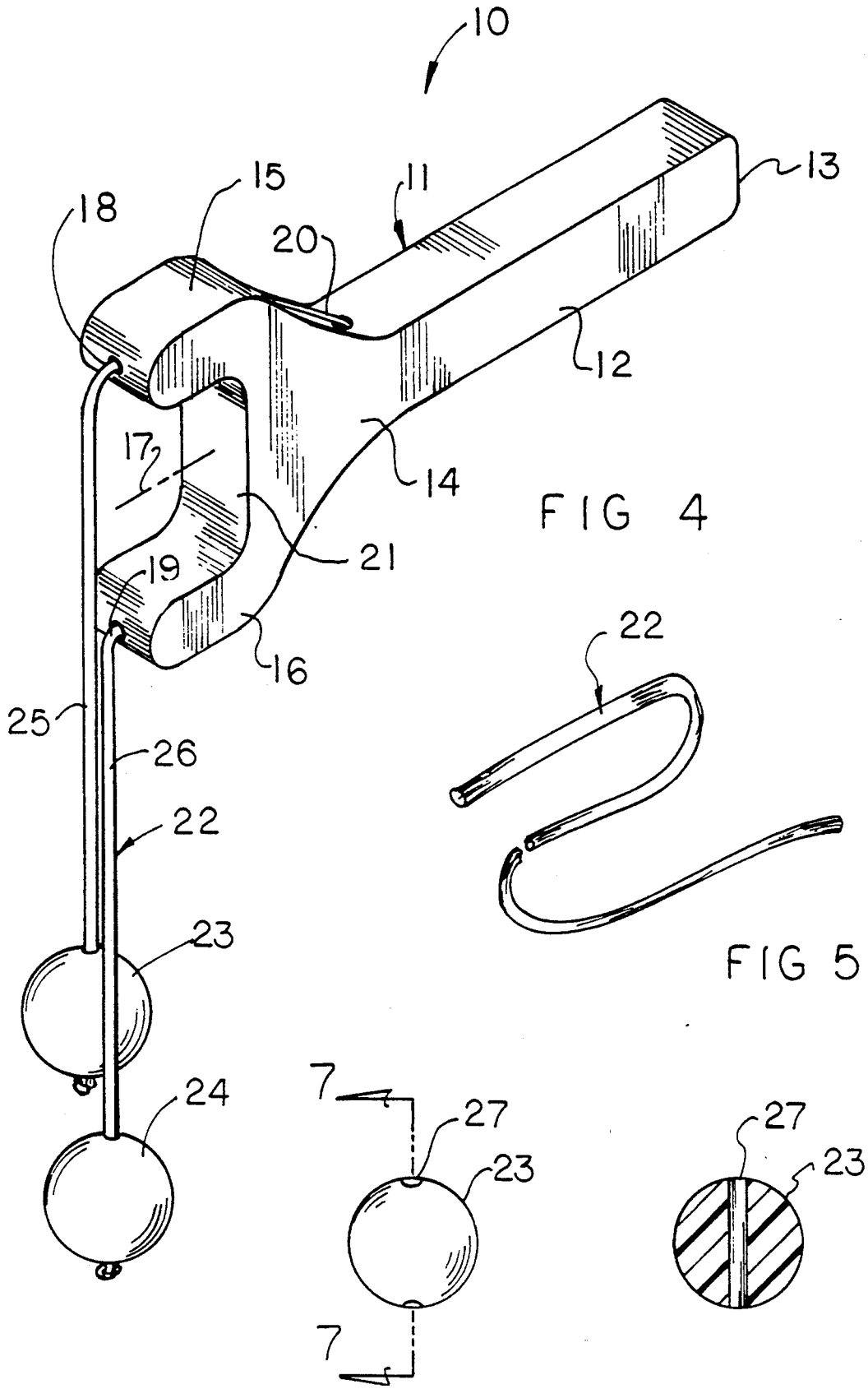
FIG. 4 is an isometric illustration of the invention.
FIG. 5 is an isometric illustration of the flexible cord structure utilized by the invention.
FIG. 6 is an orthographic view of one of the spheres utilized by the invention.
FIG. 7 is an orthographic view, taken along the lines 7—7 of FIG. 6 in the direction indicated by the arrows.

A flexible cord 22 is provided, with the flexible cord directed through the first leg bore 18, the handle shaft bore 20, and the second leg bore 19. A first sphere 23 is mounted to a first end of the flexible cord 22, with a second sphere 24 mounted to a second end of the flexible cord 22. Accordingly, a first cord segment 25 is directed from the first leg bore 18 to the first sphere 23, with a second cord segment 26 directed from the second leg bore 19 to the second sphere 24. The first and second cord segments are arranged such that the first and second legs in an overlying relationship as indicated to position the first and second cord segments in adjacency, as indicated in FIG. 4, and positions the first sphere 23 in a spacing above the second sphere 24. Typically such spacing is one and one-half inches, but may vary somewhat in use of the organization.

In use of the organization, the first and second cord segments are positioned, as indicated in FIG. 4, in a parallel adjacency relative to one another positioning the first sphere above the second sphere. The handle shaft 12 is positioned in an oscillating, vertical orientation, while the first cord segment positioned between the first bore 18 and the handle shaft bore 20 is arrested by the thumb of an individual to initiate rotation of the spheres. The second sphere is held taut during such oscillation, whereupon the displacement and positioning of the first sphere substantially one hundred eighty degrees relative to the second sphere indicates a user of the organization to release the second sphere to permit the second sphere to begin a contrarotation relative to the first sphere. Upon subsequent practice, the spheres are directed in a contrarotation relative to one another for the entertainment, amusement, and manual dexterity enhancement of a user.

The spheres each include a sphere bore 27 diametrically directed through each sphere to receive the cord therethrough in mounting of the spheres.

Figure 8:
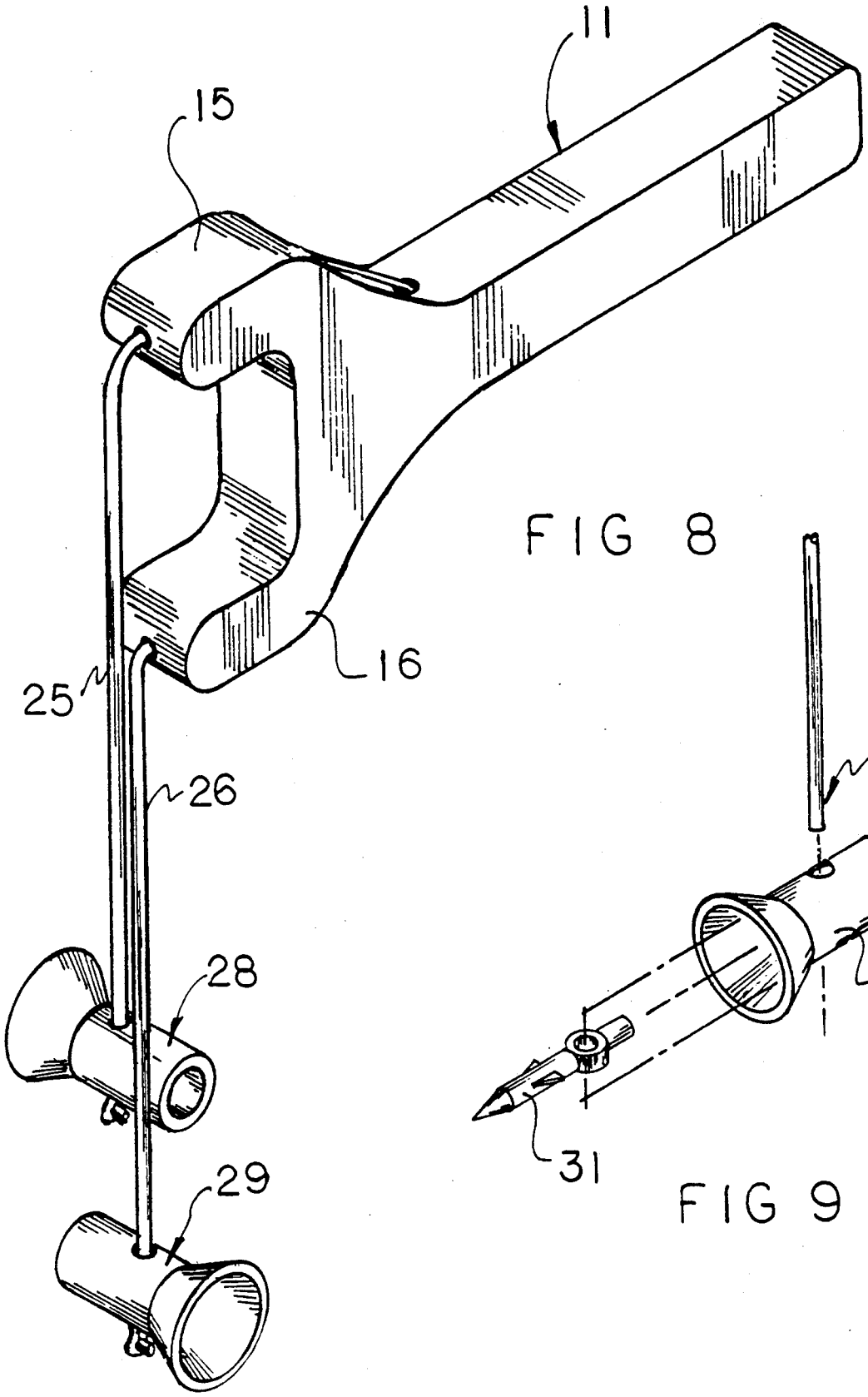
FIG. 8 is an isometric illustration of the toy structure employing whistle structure.
Figure 9:
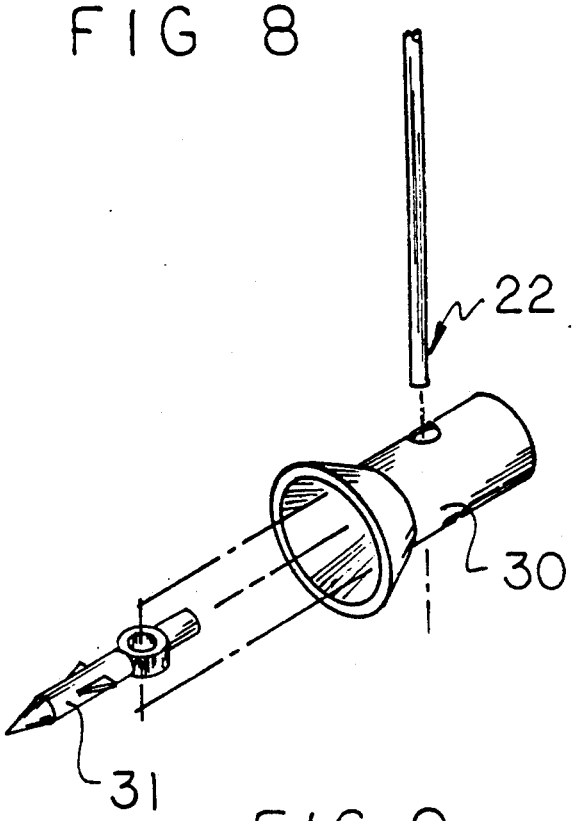
FIG. 9 is an isometric, enlarged illustration of the whistle structure as set forth in FIG. 8.

The FIG. 8 indicates the use of first and second whistle members 28 and 29 mounted to the free ends of the respective first and second cord segments 25 and 26, each having a whistle body 30 and a whistle body insert 31 to provide for an alternative audible mass at the end of each cord segment in addition to the visual effect of the rotating spheres relative to the handle shaft 12.

Figure 10:
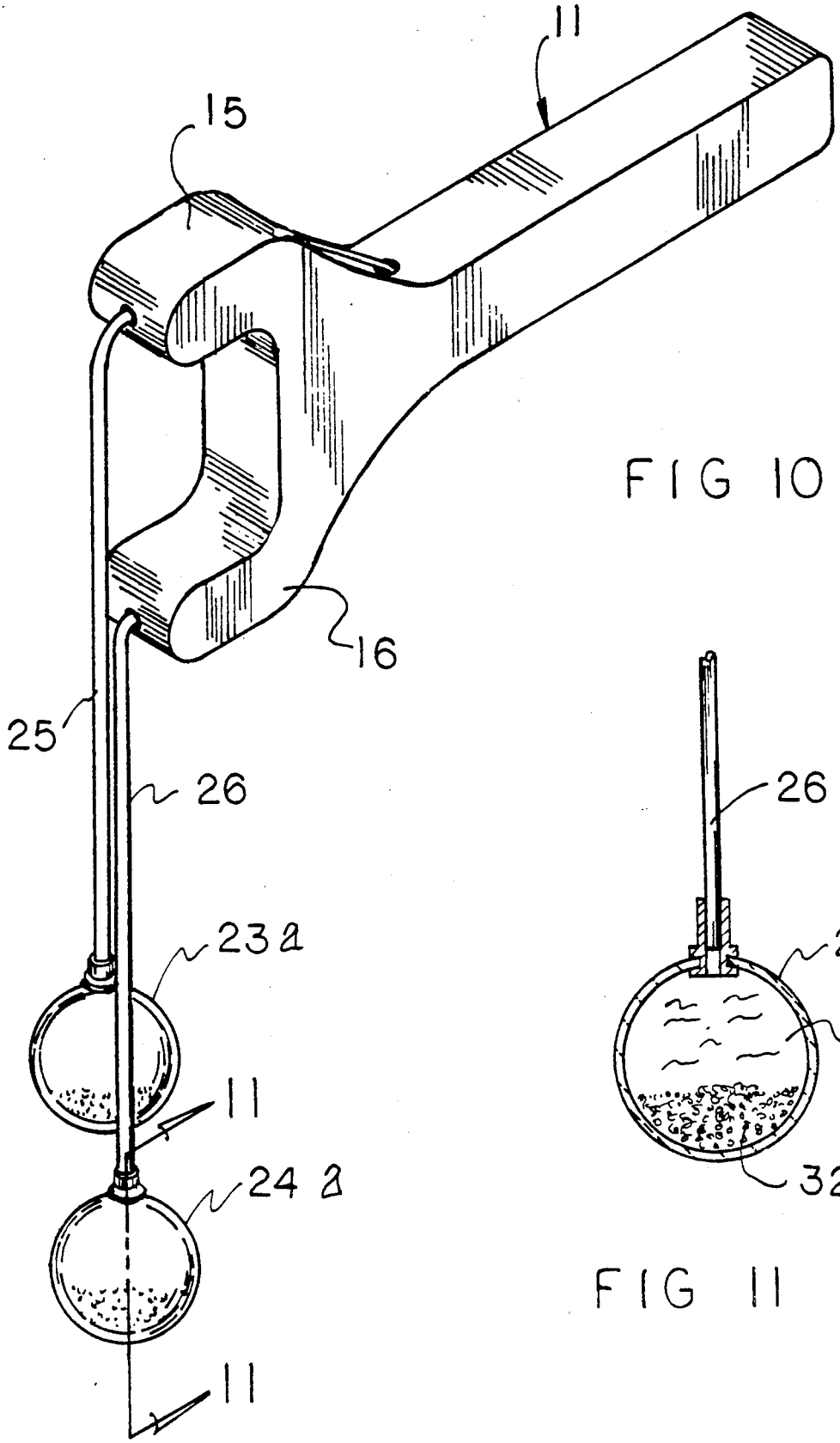
FIG. 10 is an isometric illustration of the invention employing modified sphere structure.
Figure 11:
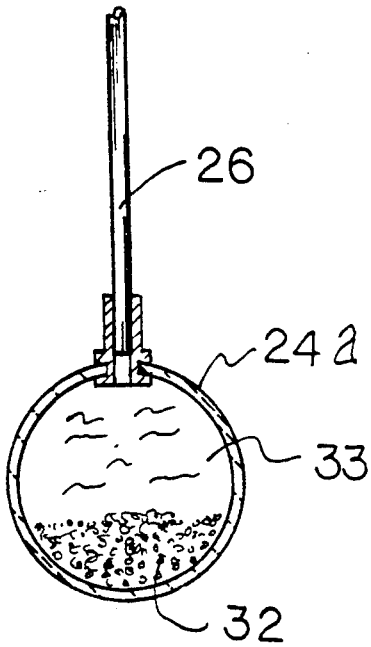
FIG. 11 is an orthographic view, taken along the lines 11—11 of FIG. 10 in the direction indicated by the arrows.

The FIGS. 10 and 11 indicate modified first and second spheres 23*a* and 24*a* respectively, having respective first and second cavities each formed of a transparent shell construction, each having a viscous fluid 33 containing light reflective metallic particles 32 within the viscous fluid 33. In this manner, enhance visual entertainment is afforded in use of the organization.

As to the manner of usage and operation of the instant invention, the same should be apparent from the above disclosure and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A twirling toy, comprising, a handle member, the handle member having an elongate, rigid shaft, the shaft having a shaft axis and the shaft longitudinally aligned about the shaft axis, with the shaft having a first free end and a bifurcated second end, the bifurcated second end including a first leg and a second leg, with the first leg and second leg arranged in a parallel relationship relative to one another, and an equal distance relative to the shaft axis, and a flexible cord mounted to the bifurcated second end, and the flexible cord having a cord first end and a cord second end, the cord first end mounting a first sphere, the cord second end mounting a second sphere.

2. A twirling toy as set forth in claim 1 wherein the first leg includes a first leg bore, the second leg includes a second leg bore, the first leg bore and the second leg bore arranged parallel relative to one another and the shaft axis and spaced an equal distance relative to the shaft axis, and the handle shaft having a handle shaft bore, with the handle shaft bore orthogonally oriented relative to the shaft axis and positioned in adjacency relative to the bifurcated second end, with the flexible cord directed through the first leg bore, the handle shaft bore, and the second leg bore, with the cord first end extending from the first leg bore and the cord second end extending from the second leg bore.

3. A twirling toy as set forth in claim 2 wherein the first sphere and the second sphere are transparent and have respective first and second cavities, wherein the first cavity and second cavity each include a viscous fluid contained therewithin, and the viscous fluid includes a plurality of light reflective metallic particles contained therewithin in suspension within the viscous fluid within the first cavity and the second cavity.

* * * * *